US012257517B1

(12) United States Patent
Liang

(10) Patent No.: US 12,257,517 B1
(45) Date of Patent: Mar. 25, 2025

(54) SPINNING WHEEL TOY

(71) Applicant: Yusheng Liang, Gaozhou (CN)

(72) Inventor: Yusheng Liang, Gaozhou (CN)

( * ) Notice: Subject to any disclaimer, the term of this patent is extended or adjusted under 35 U.S.C. 154(b) by 173 days.

(21) Appl. No.: 18/409,742

(22) Filed: Jan. 10, 2024

(30) Foreign Application Priority Data

Nov. 14, 2023 (CN) ..... 202323075998.5

(51) Int. Cl.
*A63F 5/04* (2006.01)

(52) U.S. Cl.
CPC ..... *A63F 5/046* (2013.01)

(58) Field of Classification Search
CPC ..... A63F 5/046
See application file for complete search history.

(56) References Cited

U.S. PATENT DOCUMENTS

D380,780 S * 7/1997 Capote ..... D21/374
8,123,585 B1 * 2/2012 Strong ..... A63H 1/10 446/259
D690,368 S * 9/2013 Wojdyla-Gray ..... D21/374
2019/0275830 A1 * 9/2019 Deetz ..... B43L 1/045

* cited by examiner

*Primary Examiner* — Jeffrey S Vanderveen
(74) *Attorney, Agent, or Firm* — Ying-Ting Chen

(57) ABSTRACT

A spinning wheel toy includes a spinning disk, a pointer, a support and a stand, wherein the spinning disk and the pointer are detachably mounted to the support, and the support is detachably mounted to the stand, so that the components are easy to assemble and can be used as tabletop spinner toy or other use scenarios, so as to allow an individual to rotate it freely during work or study breaks, achieving the effect of temporarily shifting personal attention or releasing stress.

10 Claims, 16 Drawing Sheets

A

B

SPINNING WHEEL TOY

CROSS REFERENCE OF RELATED APPLICATION

This application is a non-provisional application that claims priority under 35U.S.C. § 119 to China application number CN202323075998.5, filing date Nov. 14, 2023, wherein the entire content of which is expressly incorporated herein by reference.

BACKGROUND OF THE PRESENT INVENTION

Field of Invention

The present invention relates to an amusement and pressure relief toy, and more particularly to a spinning wheel toy which is convenient to install for personal use.

Description of Related Arts

People are now generally living in a high-pressure state with fast-paced lifestyles and work rhythms. If they do not receive effective relief and release for a long time, their physical and mental health will be adversely affected, especially their mental health. Studies have shown that the health problems of individuals who are in a sub-healthy state for a long time are often caused by mental health problems. With the development of society and changes in lifestyle concepts, more and more people are beginning to pay attention to the guidance and maintenance of mental health.

Under the premise of high-paced work, most people can only use fragmented time to focus on and solve their own mental health problems. Therefore, in order to achieve the purpose of releasing personal stress in fragmented time periods, various pressure relief devices have emerged and developed. The spinning wheel toy is one of the pressure relief devices which helps to give a determining choice by pushing the spinning wheel toy to rotate and eventually fall in a position after stopping the rotation, so that people can release stress and feel pleasure during the game.

The conventional spinning wheel toys are often used for large-scale commercial or entertainment activities, such as for use in party lotteries or lottery draws in shopping malls and stores, they are large in size, occupying a lot of space, and are relatively complex to install and fix, and are not suitable for personal or household use.

SUMMARY OF THE PRESENT INVENTION

The invention is advantageous in that it provides a spinning wheel toy, wherein the spinning wheel toy is suitable for personal or family use scenarios and can provide pressure relief effects in a user's fragmented time periods.

Another advantage of the present invention is to provide a spinning wheel toy, wherein the spinning wheel toy has a relatively small volume and is suitable for being placed on a desktop, such as an office desk and a home table, to allow an individual to rotate it freely during work or study breaks, achieving the effect of temporarily shifting personal attention or releasing stress.

Another advantage of the present invention is to provide a spinning wheel toy, wherein the spinning wheel toy is suitable for a fortune game, an indoor or outdoor party, or an holiday activity to give pleasures to individuals.

Another advantage of the present invention is to provide a spinning wheel toy which can be a tabletop spinner or can be used in a vehicle.

Another advantage of the present invention is to provide a spinning wheel toy which comprises a rotating disk and a pointer, wherein the pointer is provided at a position corresponding to a central area of the rotating disk, so that the entire structure is compact.

Another advantage of the present invention is to provide a spinning wheel toy, wherein the pointer can be rotated to adjust its arrow pointing direction, so as to ensure its randomness.

Another advantage of the present invention is to provide a spinning wheel toy, wherein the rotating disk can be driven to rotate with respect to a rotation bearing, so that the rotation of the rotating disk is smooth, and it also ensures randomness.

Another advantage of the present invention is to provide a spinning wheel toy, wherein a damping ring can be provided to have a frictional contact with the rotating disk, so as to slow down the rotating speed of the rotating disk, and thus the rotating disk will be stopped earlier, so that the user is not required to wait for a relatively long time.

Another advantage of the present invention is to provide a spinning wheel toy, wherein an attach element may be provided at a base of the spinning wheel toy, so as to enhance the attachment between the environment surface and the base of the spinning wheel toy, so that the spinning wheel toy is not easy to tip over.

Another advantage of the present invention is to provide a spinning wheel toy, wherein the rotating disc comprises a plurality of partition sections, wherein the outcome and prize of each partition section can be replaced according to the actual need of the user, so as to add fun to the user.

Another advantage of the present invention is to provide a spinning wheel toy, wherein the spinning wheel toy has a simple structure, is easy to install and dismantle, reduces the installation and dismantling procedures, so that the user can independently complete the assembly and operation of the spinning wheel toy.

Another advantage of the present invention is to provide spinning wheel toy which has a relatively small size, a simple structure, and fewer parts, so that it can effectively reduce costs, save expenses, and improve the applicability of the spinning wheel toy.

Another advantage of the present invention is to provide spinning wheel toy which comprises a small number of parts before and after installation and disassembly, and has a small volume, so it is easy to transport and carry, thereby further improving the wide spread and use of the spinning wheel toy.

Additional advantages and features of the invention will become apparent from the description which follows, and may be realized by means of the instrumentalities and combinations particularly pointing out in the appended claims.

According to the present invention, the foregoing and other objects and advantages are attained by a spinning wheel toy, comprising:

- a spinning disk;
- a pointer;
- a support, wherein the spinning disk and the pointer are detachably mounted to the support; and
- a stand for supporting the support.

According to an embodiment, the support comprises a fixing axle, wherein the spinning disk has a central hole, wherein the fixing axle is arranged to penetrate through the central hole of the spinning disk for detachably mounting the pointer.

According to an embodiment, the fixing axle comprises a threaded end portion, wherein the pointer comprises an engaging portion having an engaging hole, wherein the threaded end portion of the fixing axle is arranged to be engaged with the engaging hole of the engaging portion of the pointer for detachably mounting the pointer with the support.

According to an embodiment, the pointer comprises a cap portion and an arrow mark on the cap portion, wherein the engaging portion is disposed in the cap portion to define a circular groove around the engaging portion.

According to an embodiment, the fixing axle comprises an axle portion, wherein the spinning disk comprises a rotation bearing disposed in the central hole to allow the axle portion of the fixing axle to pass through, so as to allow the spinning disk to rotate about the axle portion of the fixing axle.

According to an embodiment, the spinning disk comprises a disk body and a mounting member extended from the disk body, wherein the disk body has a middle hole, the mounting member has a middle groove aligned with the middle hole of the disk body to form the central hole of the spinning disk, wherein the rotation bearing has a bearing hole and the rotation bearing is disposed in the middle groove of the mounting member, wherein the fixing axle is arranged to penetrate the bearing hole of the rotation bearing for coupling with the pointer.

According to an embodiment, the fixing axle comprises an axle portion, wherein the threaded end portion is extended from the axle portion, wherein the spinning disk comprises a rotation bearing disposed in the central hole to allow the axle portion of the fixing axle to pass through, so as to allow the spinning disk to rotate about the axle portion of the fixing axle.

According to an embodiment, the support further comprises an adapter which comprises a cylindrical engaging portion extended from the axle portion for engaging with the middle groove of the mounting member, wherein the rotation bearing is disposed in the mounting member to form an indented groove in the mounting member, wherein the cylindrical engaging portion is arranged to bias against the rotation bearing when the cylindrical engaging portion is disposed into the indented groove.

According to an embodiment, the spinning disk further comprises a retaining ring and a plurality of balls, wherein the retaining ring and the plurality of balls are disposed in the mounting member, wherein a raceway is defined between the retaining ring and the rotation bearing, wherein the plurality of balls is disposed in the raceway.

According to an embodiment, the adapter further comprise a seat portion, wherein the cylindrical engaging portion is extended from the seat portion, wherein a damping ring is wound around the cylindrical engaging portion and sandwiched between an end of the mounting member and the seat portion.

According to an embodiment, the spinning wheel toy further comprises a damping ring which is arranged to be wound around the fixing axle of the support and provided between the pointer and the spinning disk.

According to an embodiment, the spinning wheel toy further comprises a damping ring which is arranged to be wound around the fixing axle of the support and provided between the pointer and the spinning disk to have a contact with the rotation bearing and is spaced apart from the pointer.

According to an embodiment, the spinning wheel toy further comprises a damping assembly which comprises a damping ring, a first plane bearing, and a second plane bearing, wherein the damping ring, the first plane bearing, and the second plane bearing are arranged to be mounted on the fixing axle, wherein the first plane bearing and the second plane bearing are arranged to be provided at two sides of the spinning disk, wherein the damping ring is arranged between the spinning disk and one of the first plane bearing and the second plane bearing to have a frictional contact with the spinning disk.

According to an embodiment, the fixing axle comprises a threaded end portion and an axle portion, wherein the damping ring, the first plane bearing, and the second plane bearing are arranged on the axle portion of the fixing axle, wherein the damping assembly further comprises an adjusting knob which is arranged to be coupled with the threaded end portion by threads, so as to adjust position of the damping ring.

According to an embodiment, the support comprises a retention element which is detachably mounted to the stand, wherein the retention element is extended from the adapter.

According to an embodiment, the retention element is pivotally mounted to the stand, so as to allow a relative position between the support and the stand to be adjusted, so as to adjust a position of the spinning disk.

According to an embodiment, the retention element has a first mounting hole, the stand comprises a fixing rod comprising an upper fixing portion having a slot and two fixing parts each having a second mounting hole, wherein the slot is defined between the two fixing parts, wherein a fixing blot element is arranged to penetrate through the first mounting hole and the second mounting holes to detachably and pivotally mounting the retention element at the slot of the fixing rod.

According to an embodiment, the stand further comprises a base, wherein the fixing rod is detachably mounted to the base.

According to an embodiment, the fixing rod comprises a lower fixing portion having a lower fixing hole, the base has an assembling hole, wherein a securing element is arranged to pass through the assembling hole to engaged with the lower fixing hole of the fixing rod to detachably mount the base with the fixing rod.

According to an embodiment, one or more attaching member each is a silicon sucker is provided at a bottom of the base.

According to an embodiment, the disk body comprises a base layer and a displaying layer attached on the base layer for being written or drawn by a dry-erase maker pen.

According to an embodiment, the disk body comprises a base layer and a plurality of section pockets each being attached on the base layer for receiving a replaceable partition section.

According to an embodiment, the disk body comprises a base layer and a plurality of displaying layers each being capable of being attached on the base layer.

According to an embodiment, the disk body comprises a base layer and a plurality of partition sections each being capable of being attached on the base layer to form an integral displaying layer.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Figure 1:
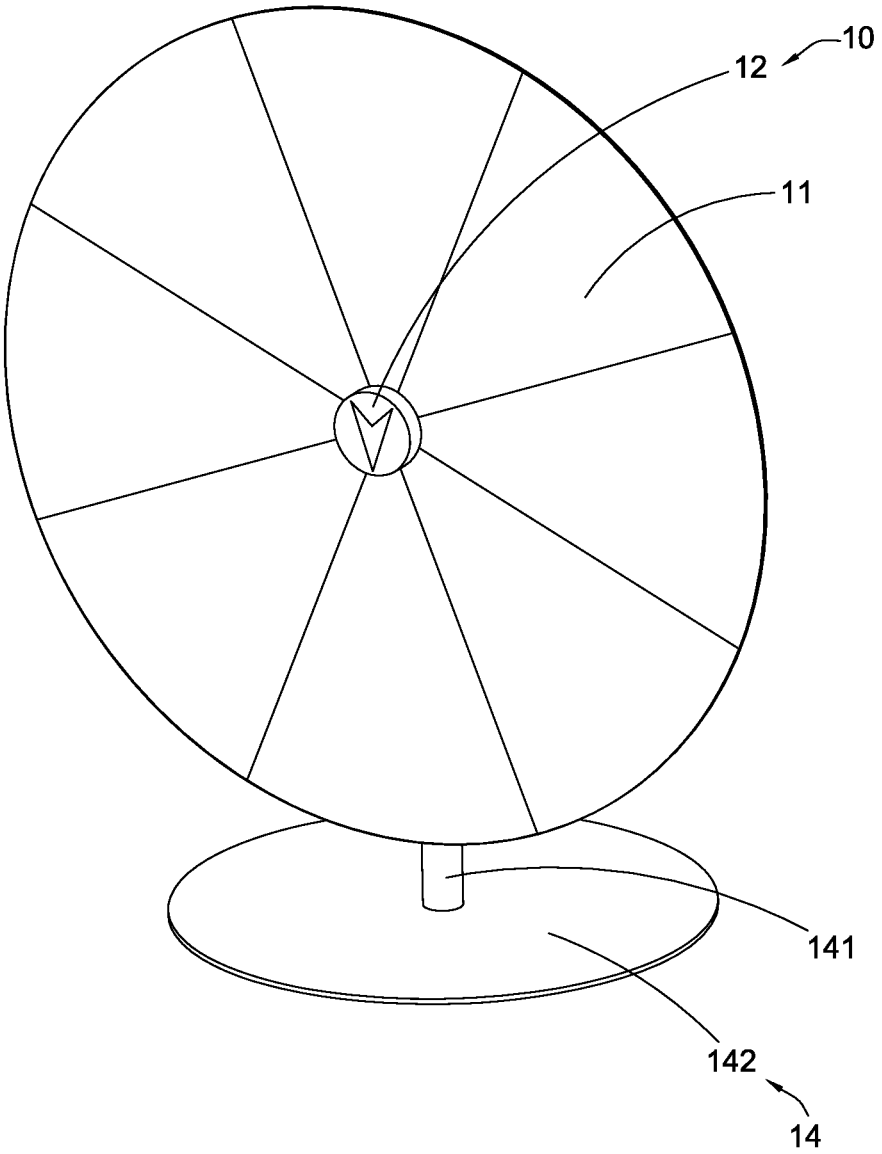
FIG. 1 is a perspective view of a spinning wheel toy according to a first preferred embodiment of the present invention.
Figure 2:
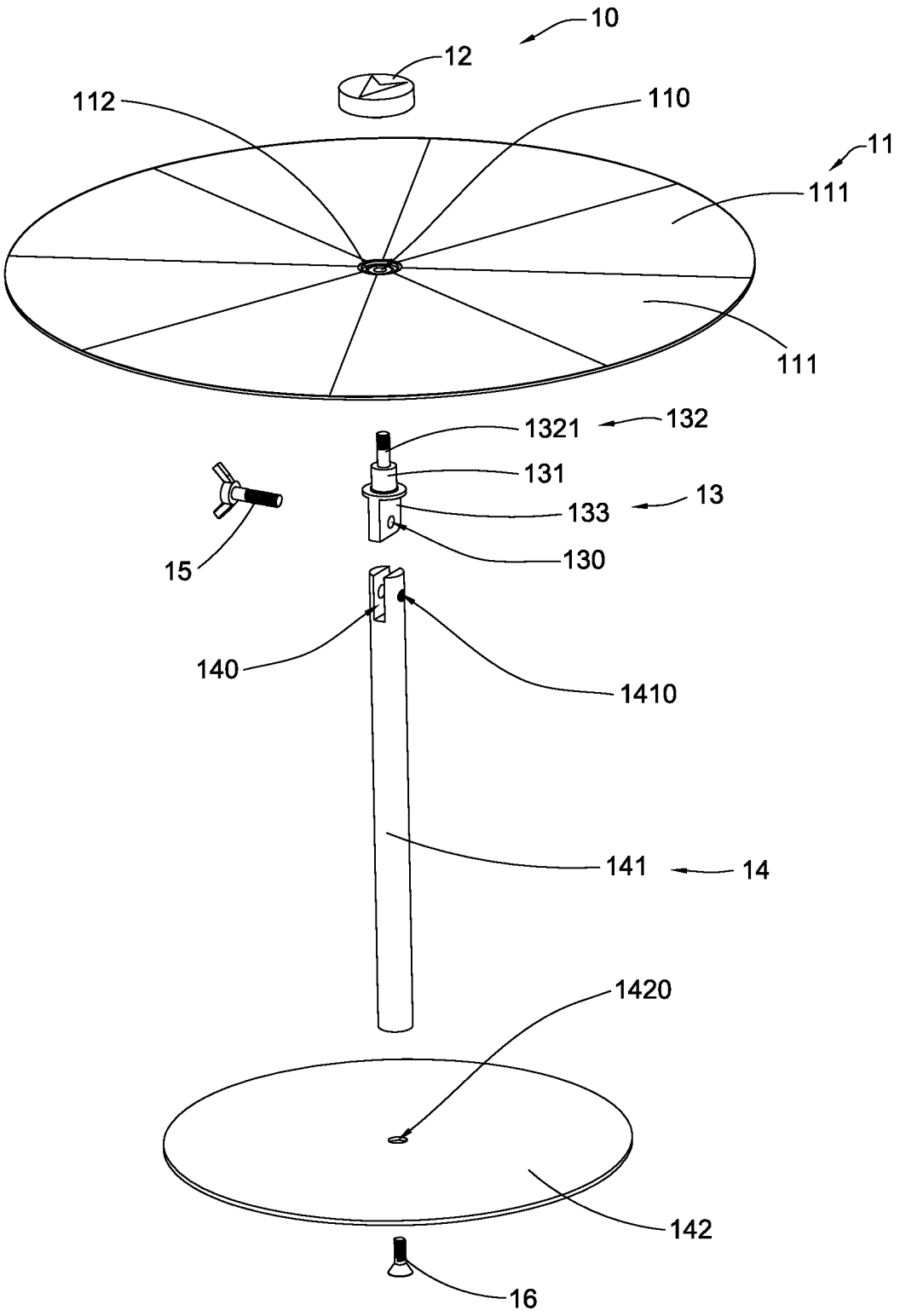
FIG. 2 is an exploded view of the spinning wheel toy according to the above first preferred embodiment of the present invention.
Figure 3:
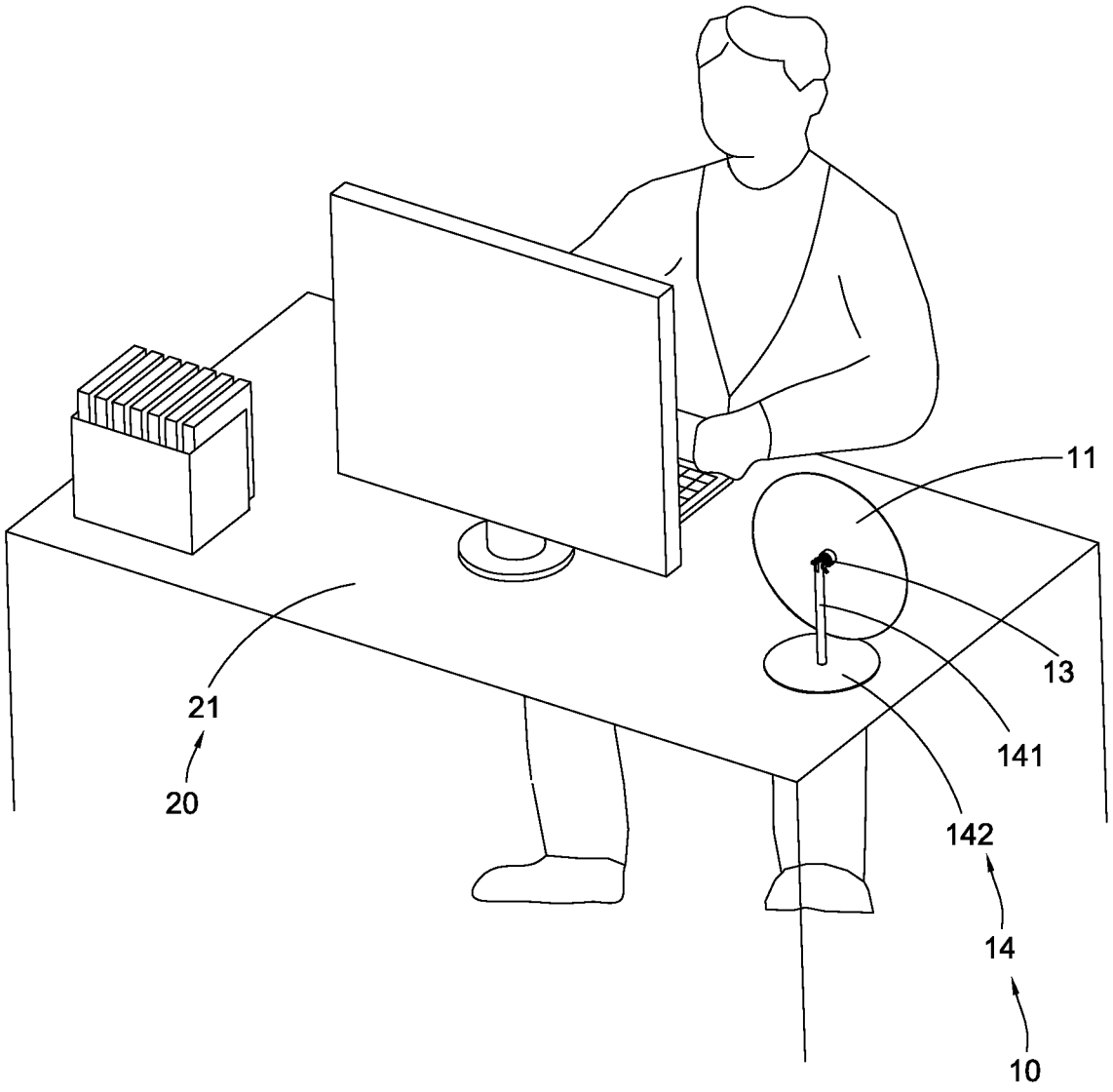
FIG. 3 is a perspective view illustrating a use scenario of the spinning wheel toy according to the above first preferred embodiment of the present invention.
Figure 4:
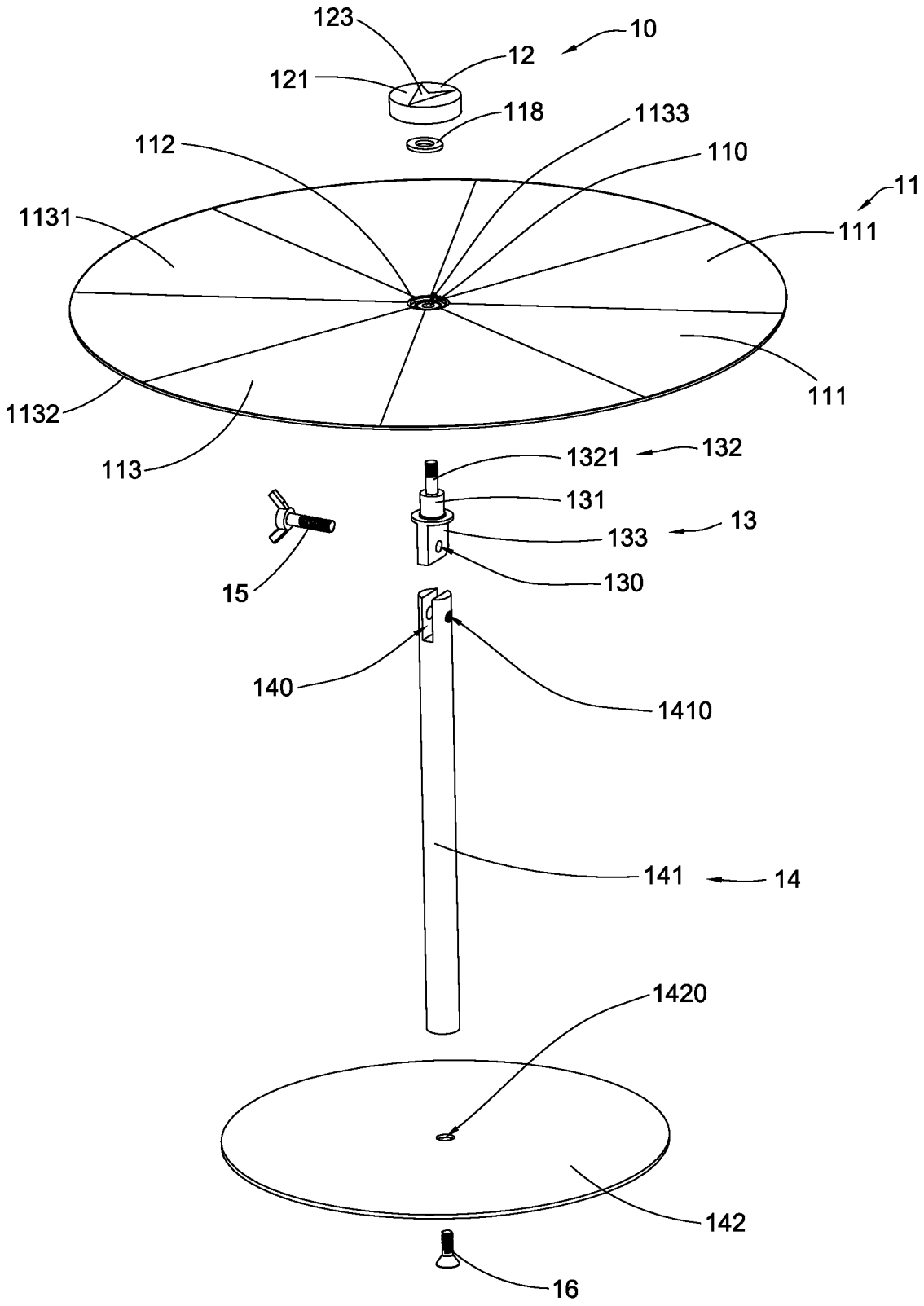
FIG. 4 is an exploded view of a spinning wheel toy according to a second preferred embodiment of the present invention.
Figure 5:
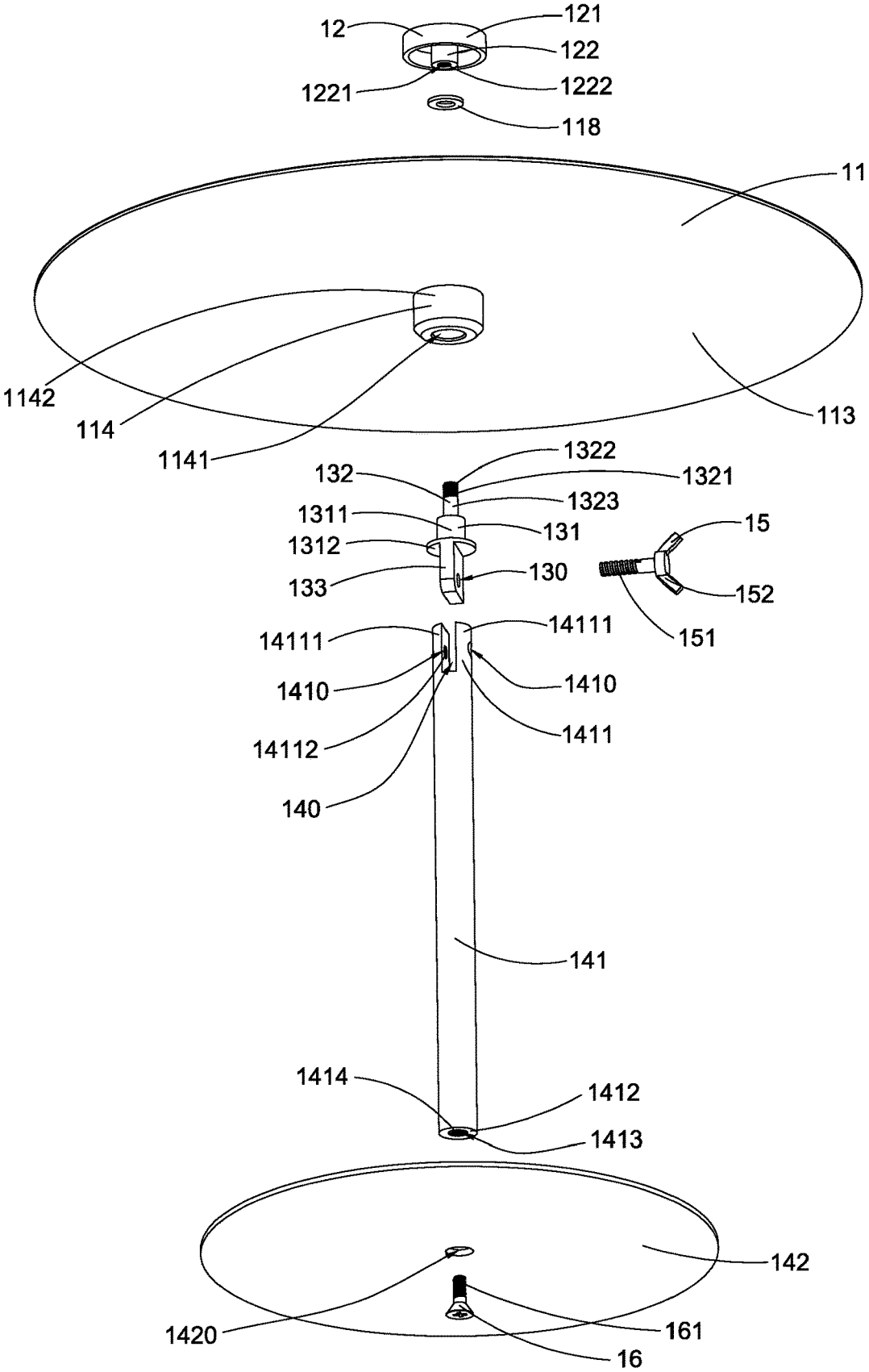
FIG. 5 is another exploded view of the spinning wheel toy according to the above second preferred embodiment of the present invention.

Referring to FIGS. 1 to 3, a spinning wheel toy 10 according to a first preferred embodiment of the present invention is illustrated. The spinning wheel toy 10 comprises a spinning disk 11 and a pointer 12, wherein the spinning disk 11 comprises a plurality of partition sections 111 and the spinning disk 11 can rotate with respect to the pointer 12. The pointer 12 can randomly point to one of the partition sections 111 of the spinning disk 11 when the spinning disk 11 stops rotation.

Specifically, as shown in FIG. 2, the plurality of partition section 111 of the spinning disk 11 are marked with identifications or other means with different meanings. When a person rotates the spinning disk 11, the spinning disk 11 will stop at a specific position after the rotation ends. At this time, the pointer 12 will also point to a partition section 111 of the spinning disk 11 and the pointed partition section 111 represents a predetermined meaning, such as eating, shopping, climbing, or any other activity.

Preferably, the spinning disk 11 is made of metal to improve the service life of the spinning wheel toy 10. As a modified embodiment of the first embodiment of the present invention, those skilled in the art can prepare the spinning disk 11 which can be made of a different material such as plastic, metal, and in combination according to actual conditions or practical needs, as long as the same or similar technical solutions as the present invention are adopted based on the disclosure of the present invention, so as to solve the same or similar technical problems described in the background, and to achieve the same or similar technical effects as the present invention, all of which are within the scope of protection of the present invention. The specific embodiment of the present invention is not limited thereto.

In the first embodiment of the present invention, the spinning wheel toy 10 further comprises a support 13, and the support 13 comprises an adapter 131 which has a cylindrical structure suitable for cooperating with the rotation of the spinning disk 11. The support 13 further comprises a fixing axle 132 which is extended from one end of the adapter 131 and can pass through the spinning disk 11 to engage with the pointer 12 to hold the pointer 12.

In the first embodiment of the present invention, the fixing axle 132 is implemented to comprise a bolt 1321. The pointer 12 is mounted to the bolt 1321 of the support 13 by a thread connection. The spinning disk 11 has a central hole 110 and the adapter 131 of the support 13 is coupled to the central hole 110 to allow the spinning disk 11 to rotate along an outer periphery of the adapter 131. The bolt 1321 pass through the central hole 110, so as to be mounted with the pointer 12.

Preferably, in the first embodiment of the present invention, a rotation bearing 112 is provided inside the central hole 110. The outer circular surface of the rotation bearing 112 is coupled to the spinning disk 11, and the inner circular surface of the rotation bearing 112 can be engaged with the adapter 131 of the support 13. Therefore, the cooperation between the rotation bearing 112 and the adapter 131 improves the rotation efficiency of the spinning disk 11, making the rotation smoother and enhancing the operability and user experience of the spinning wheel toy 10 of the present invention.

In addition, those skilled in the art can change the movement mode of the spinning disk 11 and the connection mode between the spinning disk 11 and the pointer 12 according to actual conditions or customer requirements, as long as the same or similar technical solution as disclosed in the present invention is adopted, the same or similar technical problems as the present invention are solved, and the same or similar technical effects as the present invention are achieved, the alternative modes are within the scope of the present invention, and the specific embodiment of the present invention is not limited thereto.

Furthermore, the spinning wheel toy 10 of the present invention further comprises a stand 14, and the support 13 is mounted to the stand 14 to support the spinning disk 11 which rotates on the support 13. The stand 14 can be stably placed on a desk 20, such as a home desk, an office desk, etc., so that the spinning wheel toy 10 of the present invention can be stably placed.

The stand 14 is connected to the other end of the support 13, thereby keeping the spinning disk 11 supported on the stand 14 for rotation. In the first embodiment of the present invention, the stand 14 comprises a fixing rod 141 and a base 142. The lower end of the support 13 is detachably mounted to the fixing rod 141, so that the support 13 can be separated from the stand 14 for easy transportation and storage. The base 142 can be connected to the lower end of the fixing rod 141, and the base 142 can be placed on or fixed to a surface to stably support the rotation of the spinning disk 11.

Preferably, as shown in the drawings, in the first embodiment of the present invention, the lower end of the support 13 has a first mounting hole 130, and one end of the fixing rod 141 has at least one second mounting hole 1410. The fixing rod 141 and the support 13 are tightened and fixed by a fixing bolt 15 passing through the first mounting hole 130 and the second mounting hole 1410.

Specifically, the upper end of the fixing rod 141 is provided with a slot 140 for mounting the support 13, and the lower end of the support 13 is provided with a retention element 133 for coupling with the slot 140 of the fixing rod 141. The retention element 133 can be inserted into the slot 140, and the first mounting hole 130 is formed in the retention element 133. Two second mounting holes 1410 are symmetrically arranged on two sides of the slot 140.

When the retention element 133 is inserted into the slot 140, the first mounting hole 130 and the two second mounting hole 1410 are aligned, so that the fixing bolt 15 can pass through the first mounting hole 130 and the second mounting holes 1410 to fix the support 13 with the fixing rod 141. Accordingly, the fixing blot 15 has threads, and the surfaces around the first mounting hole 130 and the second mounting holes 1410 are also provided with threads, so as to facilitate the fixing bolt 15 to tightly fix the retention element 133 to the fixing rod 141.

By tightening the fixing bolt 15, the retention element 133 of the support 13 is retained inside the slot 140 of the fixing rod 141. Conversely, when the fixing bolt 15 is loosened, a gap of between the retention element 133 and the fixing rod 141 is created, so as to allow the retention element 133 of the support 13 to pivotally move up and down within the slot 140. Since the upper end of the support 13 is connected to the spinning disk 11, the spinning disk 11 can be driven to rotate up and down by pivotally rotating the support 13 up and down.

In other words, in the first embodiment of the present invention, the angle relationship between the spinning disk 11 and the fixing rod 141 can be adjusted by adjusting the relative position between the retention element 133 and the fixing rod 141 after loosening the fixing bolt 15, so that the spinning disk 11 can be adjusted to a suitable angle for facilitating the user to operate and have fun.

As a modified embodiment of the first embodiment of the present invention, those skilled in the art can change the specific connection mode of the support 13 and the fixing rod 141 according to actual conditions or customer requirements, such as changing to a pivot connection, a threaded connection, and/or a hinge connection, as long as the same or similar technical solution as the present invention is adopted based on the disclosure of the present invention, and the same or similar technical problems as the present invention are solved, and the same or similar technical effects as the present invention are achieved, these alternative modes or modifications all fall within the scope of protection of the present invention, and the specific embodiment of the present invention is not limited thereto.

Furthermore, in the first embodiment of the present invention, the base 142 and the fixing rod 141 are detachably connected, and the base 142 has an assembling hole 1420. A securing element 16, such as a screw, passes through the assembling hole 1420 and is threadedly connected to the fixing rod 141 to vertically fix the fixing rod 141 at the center of the base 142, thereby providing support for the rotation of the spinning disk 11.

Preferably, the base 142 is constructed to be a flat round disk structure, so that it fits well on the surface of a desk 20, and the diameter of the base 142 is set to be enough to ensure that the base 142 can provide stable support when the spinning disk 11 rotates.

As a modified embodiment of the first embodiment of the present invention, the weight of the base 142 is set to be greater than the weight of the spinning disk 11, in order to counteract the gravity and centrifugal force generated during the rotation of the spinning disk 11, thereby providing stable support for the spinning disk 11.

In addition, those skilled in the art can change the shape of the base and the connection relationship between the base and the fixing rod 141 according to actual conditions. For example, the base 142 can be embodied as a square structure, or the base 142 and the fixing rod 141 can be configured as a foldable structure, all of these modifications are within the scope of protection of the present invention.

Next, a brief explanation will be given on the working process of the spinning wheel toy 10 of the present invention.

As shown in FIGS. 2 and 3, first, install the spinning disk 11 onto the support 13, then mount the pointer 12 with the fixing axle 132 of the support 13, and then insert the retention element 133 of the support 13 into the slot 140 of the fixing rod 141. Adjust and fix the angle and position between the spinning disk 11 and the fixing rod 141. Finally, connect the fixing rod 141 and the base 142 by the securing element 16. At this time, the spinning wheel toy 10 is installed.

The user can perform different markings in each partition section 111 on the spinning disk 11 before or after installation. After the spinning wheel toy 10 is installed, the user can place the spinning wheel toy 10 on a desk surface 21 of a desk 20, and then rotate the spinning disk 11, and the pointer 12 finally points to a partition section 111 of the spinning disk 11 to have fun and achieve the pressure relief effect.

Referring to FIG. 4 to FIG. 10 of the drawings, a spinning wheel toy 10 according to a second preferred embodiment of the present invention is illustrated, the spinning wheel toy 10 comprises a spinning disk 11, a pointer 12, a support 13 and a stand 14, wherein the pointer 12 and the spinning disk 11 are detachably mounted to the support 13 in a manner that the spinning disk 11 is able to rotate about the static pointer 12, and the support 13 is mounted to the stand 14 which can be placed on a desk 20, the spinning wheel toy 10 has a relatively small size that it is designed for personal use, one or more people can play the spinning wheel toy 10 during break time periods of working or studying, or during leisure time for having fun or relieving pressure.

The spinning disk 11 comprises a disk body 113 and a mounting member 114 protruded from a back of the disk body 113 for coupling with the support 13. The disk body 113 comprises a displaying layer 1131 which are divided into a plurality of partition sections 111. For example, in this embodiment, the disk body 113 comprises eight partition sections 111 which are evenly distributed along a circumferential direction.

According to this embodiment, the disk body 113 comprises a base layer 1132 and the displaying layer 1131 which is adhered to the base layer 1132 by a glue. The base layer 1132 is an integral piece and can be made of a rigid material such as metal, plastic and wood. The displaying layer 1131 is a paper layer which is provided with a dry-erase film on a surface thereof, so that the content of the outcome or prize on each partition section 111 can be written or drawn by a dry-erase maker pen. Accordingly, the user can change the content on the partition sections 111 by simply erasing and rewriting, so that it is customizable and editable during usage, and thus it adds fun to the user.

Figure 12:
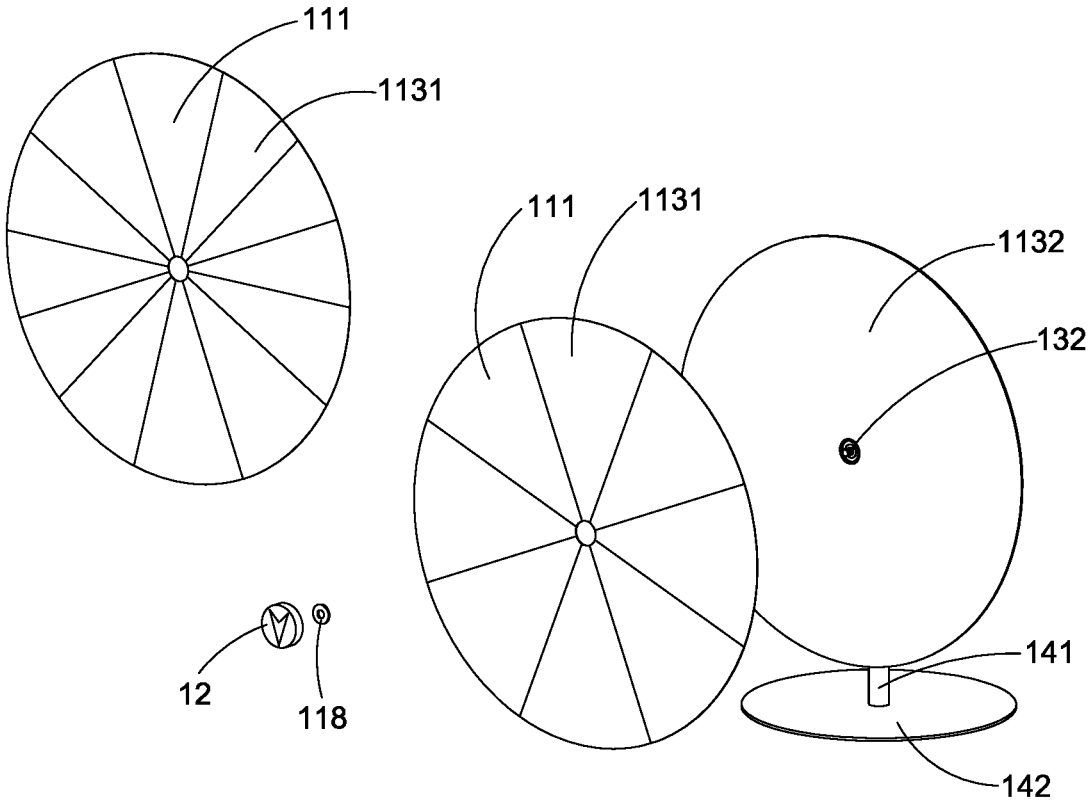
FIG. 12 is a perspective view of the spinning wheel toy according to a second alternative mode the above second preferred embodiment of the present invention.

As shown in FIG. 12 of the drawings, as an alternative mode, the spinning wheel toy of the present invention is provided with a plurality of displaying layers 1131 with different contents of the outcomes and prizes on the partition layers 111. Each displaying layer 1131 can be detachably attached to the base layer 1132, so that the displaying layer 1131 on the base layer 1132 is easy to replace.

Figure 13:
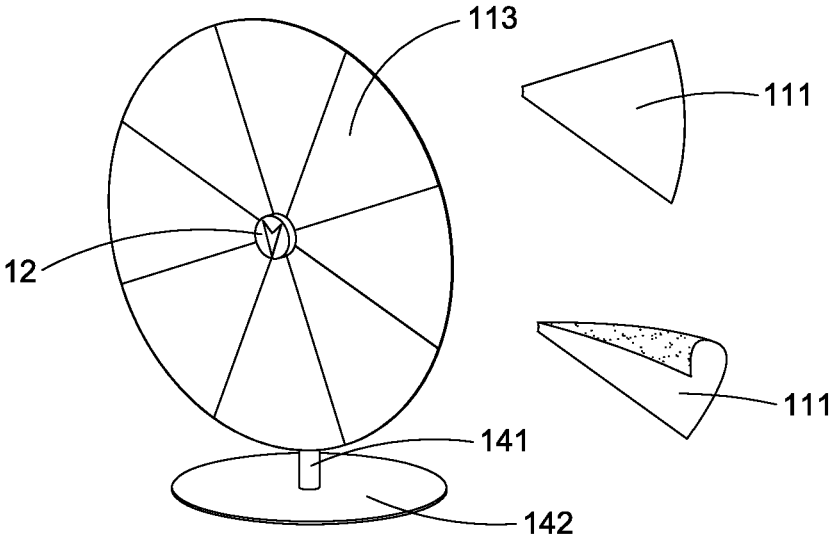
FIG. 13 is a perspective view of the spinning wheel toy according to a third alternative mode the above second preferred embodiment of the present invention.

As shown in FIG. 13 of the drawings, as another alternative mode, the spinning wheel toy of the present invention is provided with a displaying layer 1131 comprising a plurality of independent partition sections 111. Each partition section 111 can be detachably attached to the base layer 1132, so that the displaying layer 1131 on the base layer 1132 is easy to replace.

Figure 14:
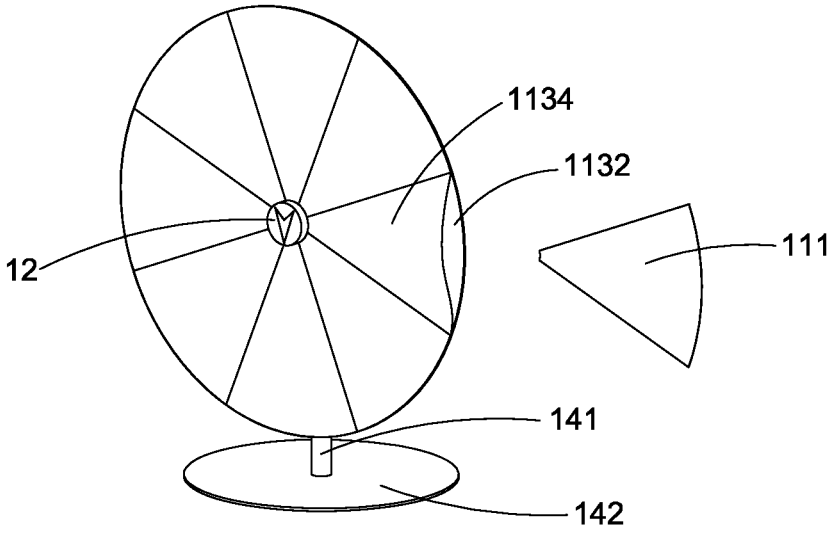
FIG. 14 is a perspective view of the spinning wheel toy according to a fourth alternative mode the above second preferred embodiment of the present invention.

As shown in FIG. 14 of the drawings, as another alternative mode, the spinning wheel toy of the present invention is provided with a plurality of section pockets 1134 which are respectively used for receiving a plurality of independent partition sections 111. Each partition section 111 is customizable and can be detachably disposed into the corresponding section pocket 1134, so that the partition section 111 on the base layer 1132 is easy to replace.

The disk body 113 has a middle hole 1133 and the mounting member 114 has an elongated middle groove 1141 which is aligned with the middle hole 1133 to define a central hole 110 of the spinning disk 11 for mounting with the support 13.

The support 13 comprises an adapter 131, a fixing axle 132 and a retention element 133, the adapter 131 is extended between the fixing axle 132 and the retention element 133, the fixing axle 132 can pass through the middle groove 1141 of the mounting member 114 and the middle hole 1133 of the disk body 113 for mounting the pointer 12, and adapter 131 can be engaged with the middle groove 1141 of the mounting member 114, and the retention element 133 is used to be connected with the stand 14.

The adapter 131 comprises a cylindrical engaging portion 1311 and a seat portion 1312, wherein the cylindrical engaging portion 1311 is integrally extended from the seat portion 1312, the cylindrical engaging portion 1311 can be engaged with the middle groove 1141 when the support 13 is mounted with the spinning disk 11 and an end 1142 of mounting member 114 is spaced apart from the seat portion 1312 to prevent the frictional contact with the seat portion 1312 when the mounting member 114 is rotating along with the disk body 113.

Accordingly, the seat portion 1312 is round in shape and has a diameter larger than a diameter of the cylindrical engaging portion 1311, and is also larger than a diameter of the middle groove 1141 of the mounting member 114 which is tubular in shape.

The fixing axle 132 is integrally extended from the cylindrical engaging portion 1311 of the adapter 131 for penetrating through the middle groove 1141 of the mounting member 114 and the middle hole 1133 of the disk body 113 for engaging with the pointer 12.

According to this embodiment, the pointer 12 is detachably mounted to the fixing axle 132. More particularly, the pointer 12 comprises a cap portion 121, an engaging portion 122, and an arrow mark 123 provided on an outer surface of the cap portion 121. The engaging portion 122 is disposed in the cap portion 121 to define a circular groove 124 between the engaging portion 122 and the cap portion 121, and the engaging portion 122 is arranged for engaging with the fixing axle 132 of the support 13. Accordingly, the circular groove 124 is created, so as to further reduce the potential contacting area between the spinning disk 11, so that the pointer 12 is maintained static when the spinning disk 11 is rotating.

The engaging portion 122 of the pointer 12 has an engaging hole 1221 for engaging with the fixing axle 132. More specifically, the fixing axle 132 comprises a threaded end portion 1322 which is provided with threads, and the engaging portion 122 comprises threads 1222 around the engaging hole 1221 for detachably coupling with the threaded end portion 1322 of the fixing axle 132 of the support 13. Alternatively, the engaging portion 122 may be formed on the fixing axle 132 and the threaded end portion 1322 may be formed on the pointer 12.

The length of the fixing axle 132 is larger than a thickness of the disk body 113 and the length of the engaging hole 1221 of the engaging portion 122 of the pointer 12, so that when the engaging portion 122 is mounted with the fixing axle 132, a gap can be created between the pointer 12 and the disk body 113, so as to prevent the cap portion 121 of the pointer 12 to have contact with the spinning disk 11, so that when the spinning disk 11 is rotating, the pointer 12 will maintain its static state.

The fixing axle 132 further comprises an axle portion 1322 which is integrally extended from the cylindrical engaging portion 1311 of the adapter 131, a diameter of the fixing axle 132 is smaller than the diameter of the cylindrical engaging portion 1311 of the adapter 131. The disk body 113 of the spinning disk 11 is capable of rotating with respect to the axle portion 1322 of the fixing axle 132.

The spinning disk 11 further comprises a rotation bearing 112, a plurality of balls 115, and a retaining ring 116, wherein a raceway 117 is defined between the rotation bearing 112 and the retaining ring 116, and the plurality of balls 115 is provided in the raceway 117 for reducing the friction between the rotation bearing 112 and the retaining ring 116, so as to ensure the smooth rotation.

Accordingly, the rotation bearing 112, the plurality of balls 115, and the retaining ring 116 are disposed in the mounting member 114. Particularly, the rotation bearing 112 is disposed in the mounting member 114 for engaging with the axle portion 1322 of the fixing axle 132, so as to allow the mounting member 114 and the disk body 113 to freely rotate about the axle portion 1322 of the fixing axle 132.

The rotation bearing 112 has a bearing hole 1121 which has a diameter that is matched with the axle portion 1322 of the fixing axle 132, and the rotation bearing 112 is disposed into the mounting member 114 and is extended into the middle groove 1141, so that an indented groove 1143 is formed in the middle groove 1141 for engaging with the cylindrical engaging portion 1311 of the adapter 131.

Accordingly, the length of the indented groove 1143 is smaller than the length of the cylindrical engaging portion 1311 of the adapter 131, and thus when the support 13 is engaged with the spinning disk 11, the end 1142 of the mounting member 114 is spaced apart from the seat portion 1312 of the adapter 131, so that a gap is formed between end 1142 of the mounting member 114 is spaced apart from the seat portion 1312 of the adapter 131 to prevent the end 1142 of the mounting member 114 to have frictional contact with the seat portion 1312 of the adapter 131.

Through the engagement between the rotation bearing 112 and the axle portion 1322 of the fixing axle 132, the smooth rotation of the spinning disk 11 is ensured. Actually, when a driving force is applied on the spinning disk 11, the spinning disk 11 can rotate with a fast speed and maintain in the rotating state for several minutes.

If the user does not want the spinning disk 11 to stop the rotating earlier, the spinning disk 11 may further comprises a damping ring 118 which is made of a flexible material such as silicon or rubber for slowing down the rotating speed of the spinning sick 11.

According to this embodiment, the damping ring 118 can be provided between the pointer 12 and the disk body 113 of the spinning disk 11 to having frictional contact with the spinning disk 11, so that the rotating time of the spinning disk 11 will be reduced.

Figure 10:
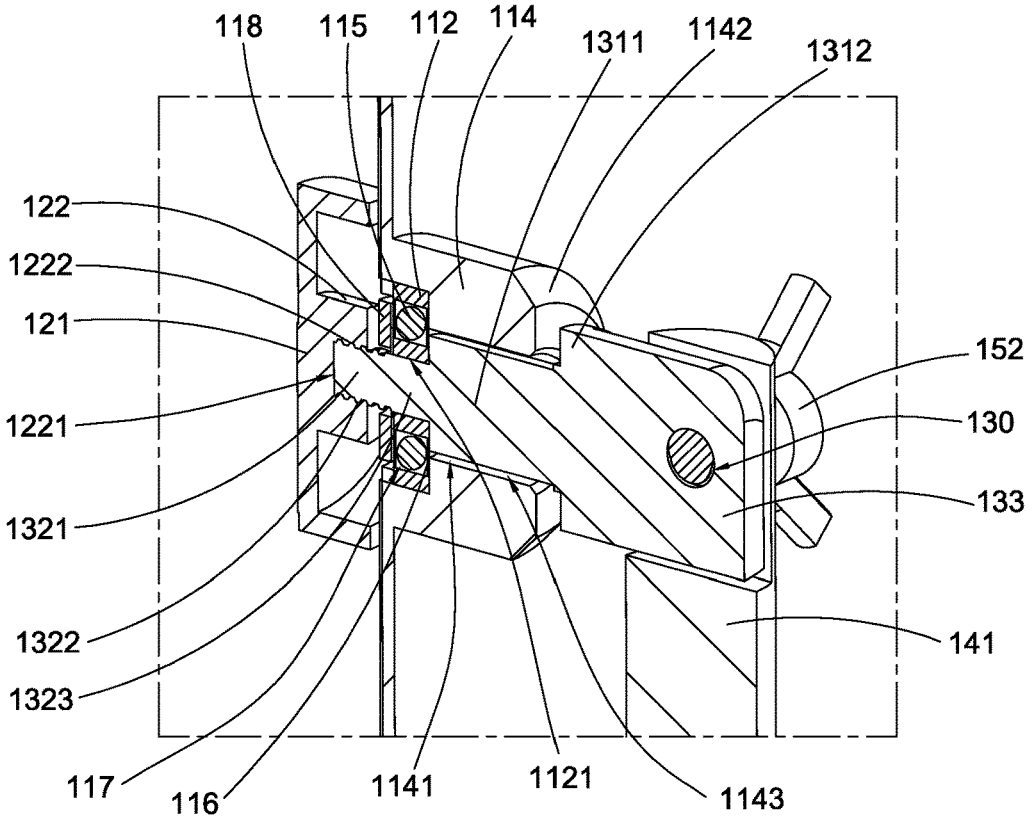
FIG. 10 is a partially enlarged sectional view of area A of FIG. 9.

As shown in FIG. 10 of the drawings, the damping ring 118 can be contacting with the rotation bearing 112 to reduce the rotating speed of the spinning disk 11, and is spaced apart from the pointer 12, so as to prevent the pointer 12 from being driven to rotate along with the spinning disk 11. Alternatively, the damping ring 118 may be contacting with the disk body 113.

Figure 11:
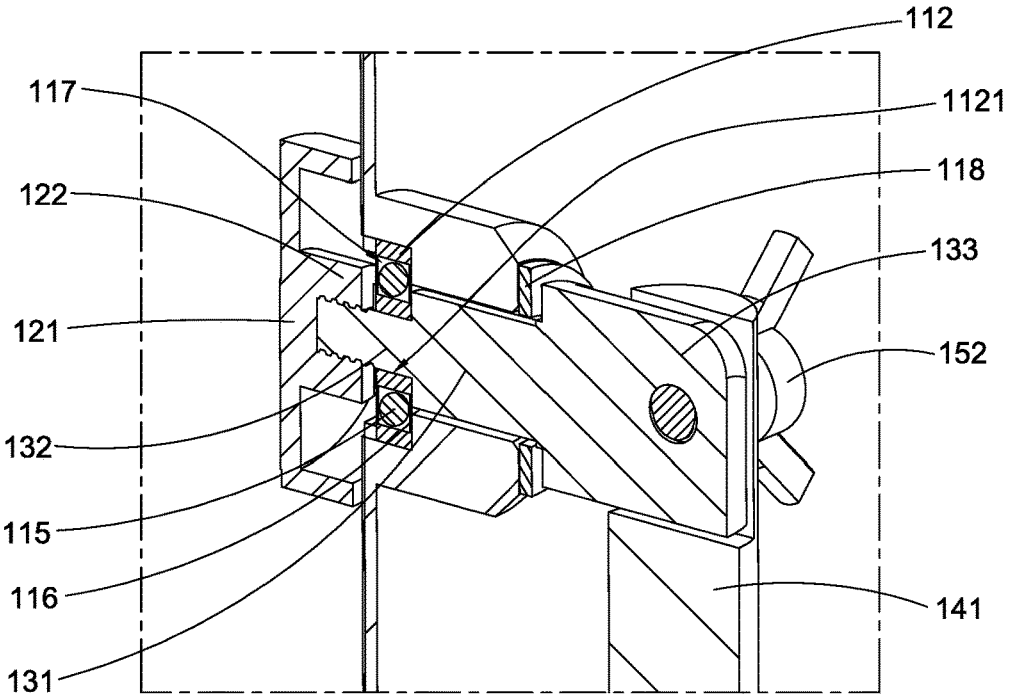
FIG. 11 is a partially enlarged sectional view of the spinning wheel toy according to a first alternative mode the above second preferred embodiment of the present invention.

As shown in FIG. 11 of the drawings, as an alternative mode, the damping ring 118 can be provided between the end 1142 of the mounting member 114 and the seat portion 1312, so that the damping ring 118 is having contact with the mounting member 114, so as to reduce the rotating speed of the mounting member 114, and thus the rotating speed of the spinning wheel 11 is reduced.

The stand 14 comprises a fixing rod 141 and a base 142, and the fixing rod 141 is detachably mounted to the base 142. The fixing rod 141 comprises an upper fixing portion 1411 having a slot 140 for retaining the retention element 133 of the support 13, and a lower fixing portion 1412 having a lower fixing hole 1413 for engaging with a securing element 16 which mount the base 142 with the fixing rod 141.

The upper fixing portion 1411 comprises two fixing parts 14111 defining the slot 140 therebetween, each fixing part 14111 has a second mounting hole 1410, and the retention element 133 has a first mounting hole 130, a fixing bolt element 15 is penetrating through the second mounting holes 1410 and the first mounting hole 130 to detachably mount the retention element 133 with the upper fixing portion 1411 of the fixing rod 141, so as to detachably mount the support 13 with the stand 14.

The fixing bolt element 15 comprises a threaded part 151 and an operation part 152 integrally extended from the threaded part 151, when the operation part 152 is operated to rotate by the user, the threaded part 151 can be driven to be screwed into the second mounting holes 1410 and the first mounting hole 130, so as to securely fix the retention element 133 with the upper fixing portion 1411 of the fixing rod 141. Accordingly, the operation part 152 can be biasing against one of the fixing parts 14111 when the retention element 133 is secured to the upper fixing portion 1411 of the fixing rod 141.

It is worth mentioning that one of the two second mounting holes 130 is provided with threads 14112, so as to engage with the threaded part 151 of the fixing bolt element 15, so as to allow the fixing bolt element 15 to fix or release the retention element 133 at the slot 140.

When the operation part 152 is rotate in an opposite direction to loose the retention element 133 sandwiched between the two fixing parts 14111, the retention element 133 is allowed to pivotally move in the slot 140 between the two fixing parts 14111 of the upper fixing portion 1411 the fixing rod 141.

Accordingly, the retention element 133 is pivotally mounted to the upper fixing portion 1411 of the fixing rod 141 that the relative position between the retention element 133 and the upper fixing portion 1411 of the fixing rod 141 can be adjusted by pivotally rotating the retention element 133 in the slot 1410 of the fixing rod, so that the position of the spinning disk 11 also can be adjusted.

Figure 6:
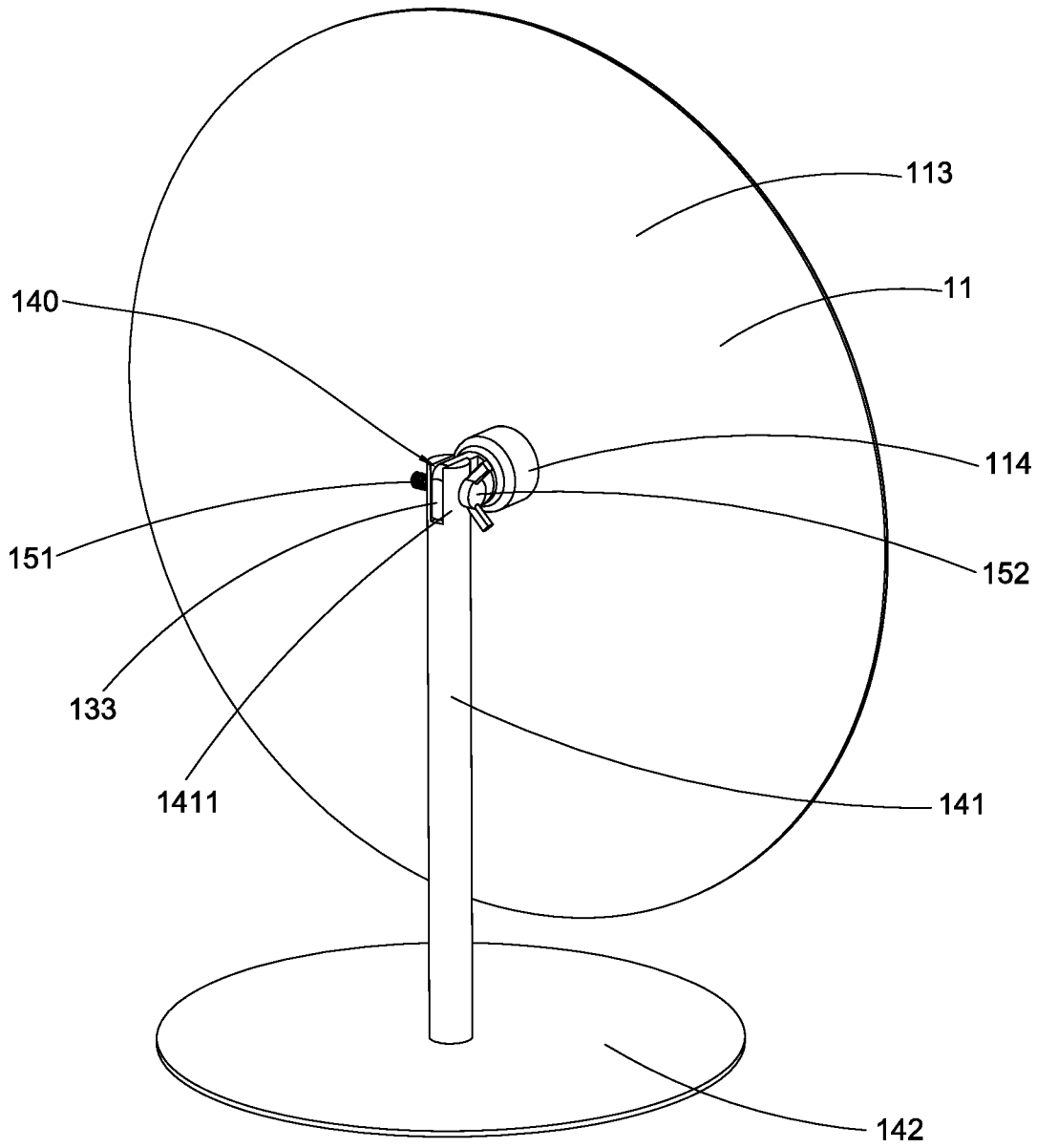
FIG. 6 is a perspective view of the spinning wheel toy according to the above second preferred embodiment of the present invention.
Figure 7:
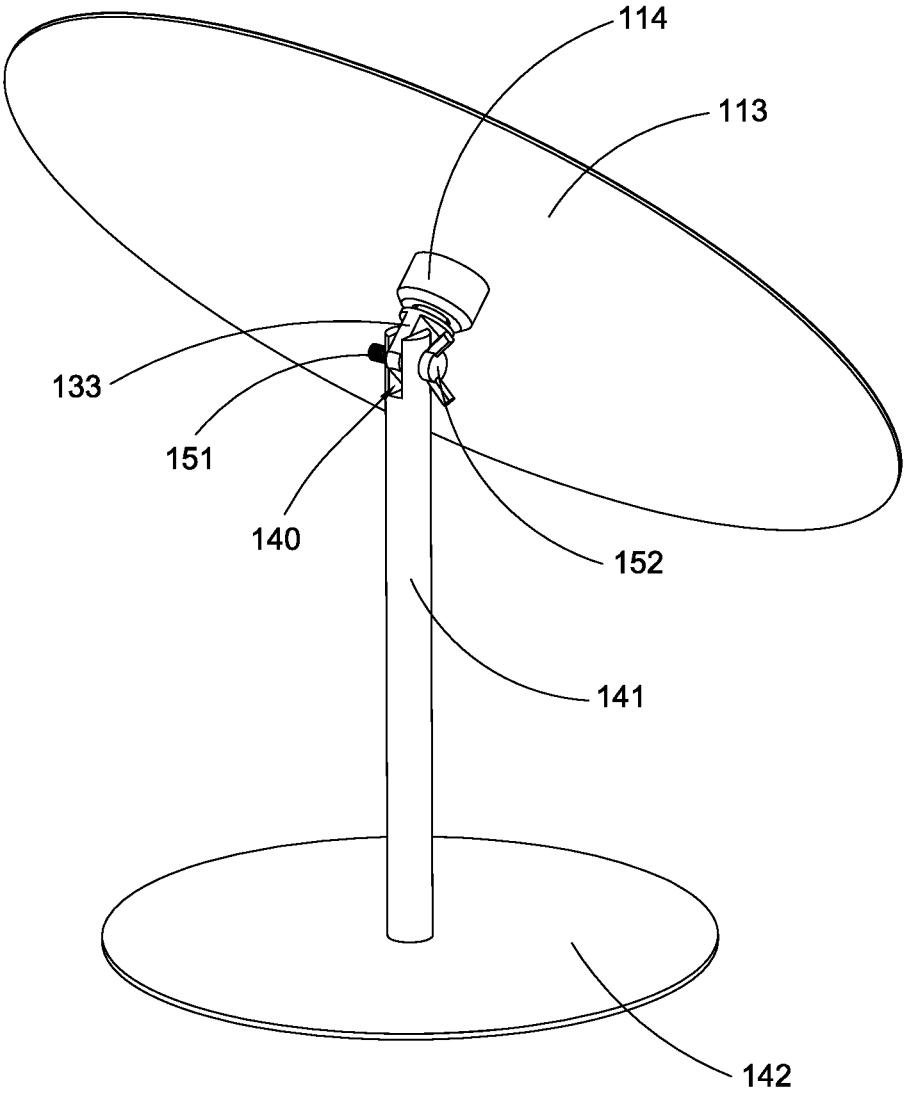
FIG. 7 is another perspective view of the spinning wheel toy according to the above second preferred embodiment of the present invention.
Figure 8:
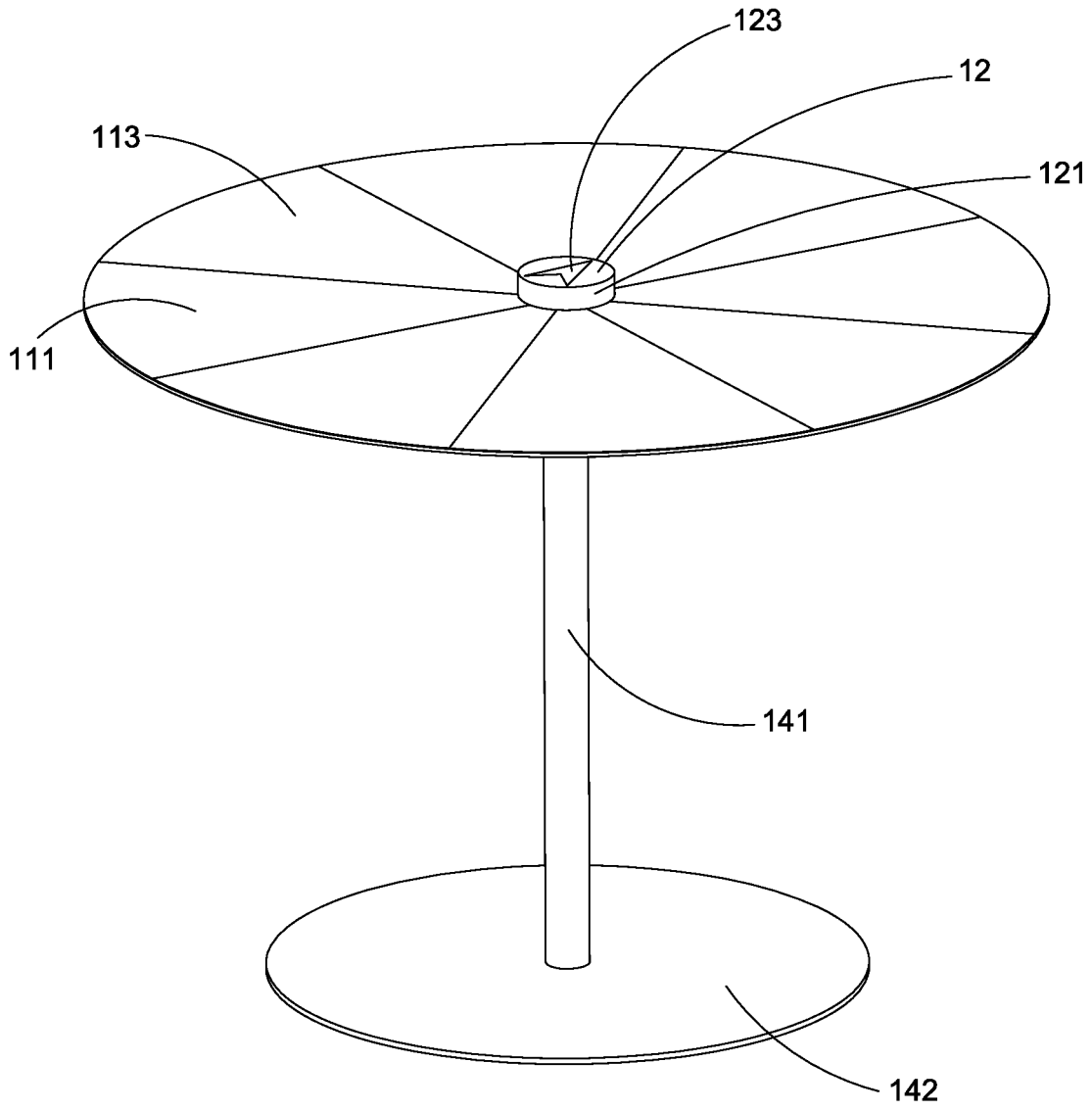
FIG. 8 is another perspective view of the spinning wheel toy according to the above second preferred embodiment of the present invention.
Figure 9:
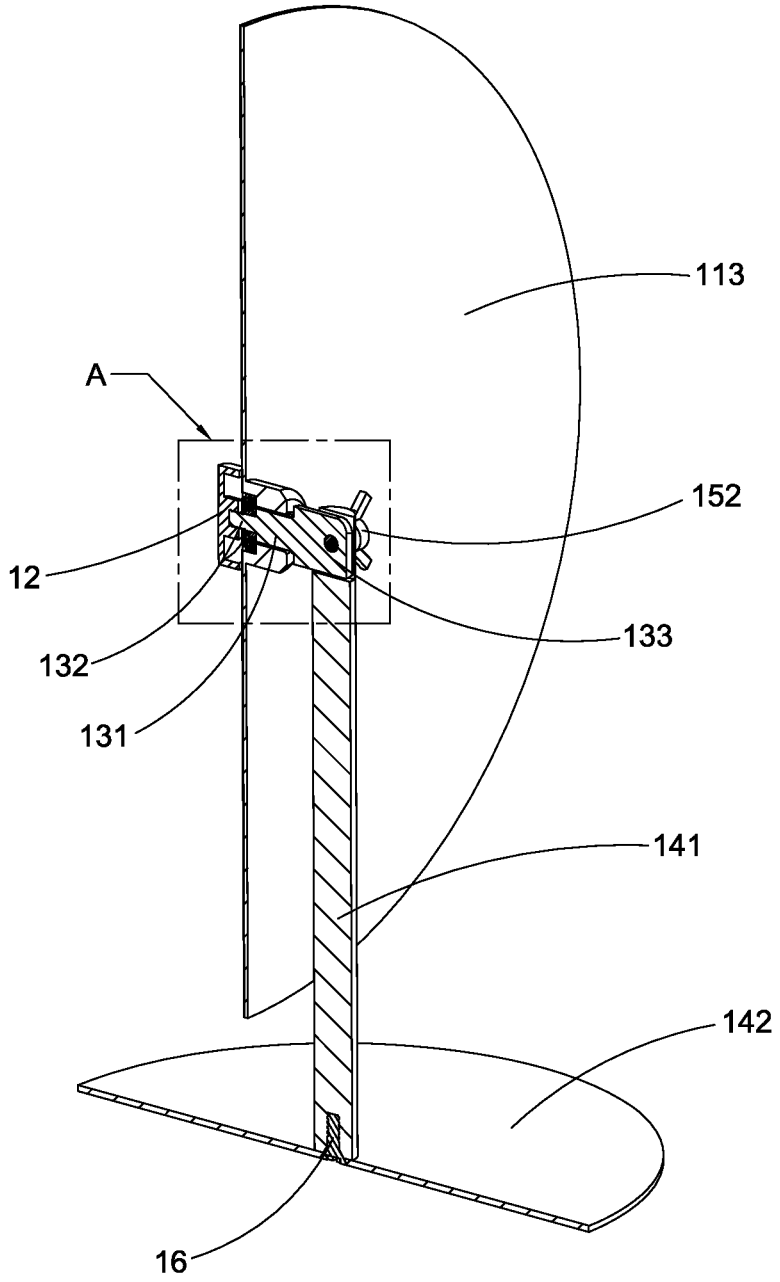
FIG. 9 is a schematic view of the spinning wheel toy according to the above second preferred embodiment of the present invention.

As shown in FIG. 6 of the drawings, the spinning disk 11 can be moved to a position that the disk body 113 is in a vertical plane when the support 13 is vertically with respect to the fixing rod 141 of the stand 14. As shown in FIG. 7 of the drawings, the spinning disk 11 can be moved to a position that the disk body 113 is in an inclined state when an included angle between the support 13 and the fixing rod 141 of the stand 14 is adjusted. As shown in FIG. 8 of the drawings, the spinning disk 11 can be moved to a position that the disk body 113 is in a horizontal plane when the support 13 and the fixing rod 141 of the stand 14 are arranged along a same vertical direction.

The base 142 has an assembling hole 1420 at a center thereof, and the securing element 16 comprises a threaded portion 161 which can be screwed into the lower fixing hole 1413 of the lower fixing portion 1412 of the fixing rod 141, and the lower fixing portion 1412 of the fixing rod 141 can be also provided with threads 1414 for engaging with the threaded portion 161 of the securing element 16, so that the fixing rod 141 can be detachably mounted to the base 142.

The base 142 can be constructed to have any suitable shape, such as round, rectangular, square. In this embodiment, the base 142 has a round shape and can be made of metal, wood, and plastic. The configuration of the base 142 and the fixing rod 141 is constructed to have an enough weight and lower the center of gravity of the spinning wheel top, so as to prevent the spinning disk 11 to tip over.

Figure 15:
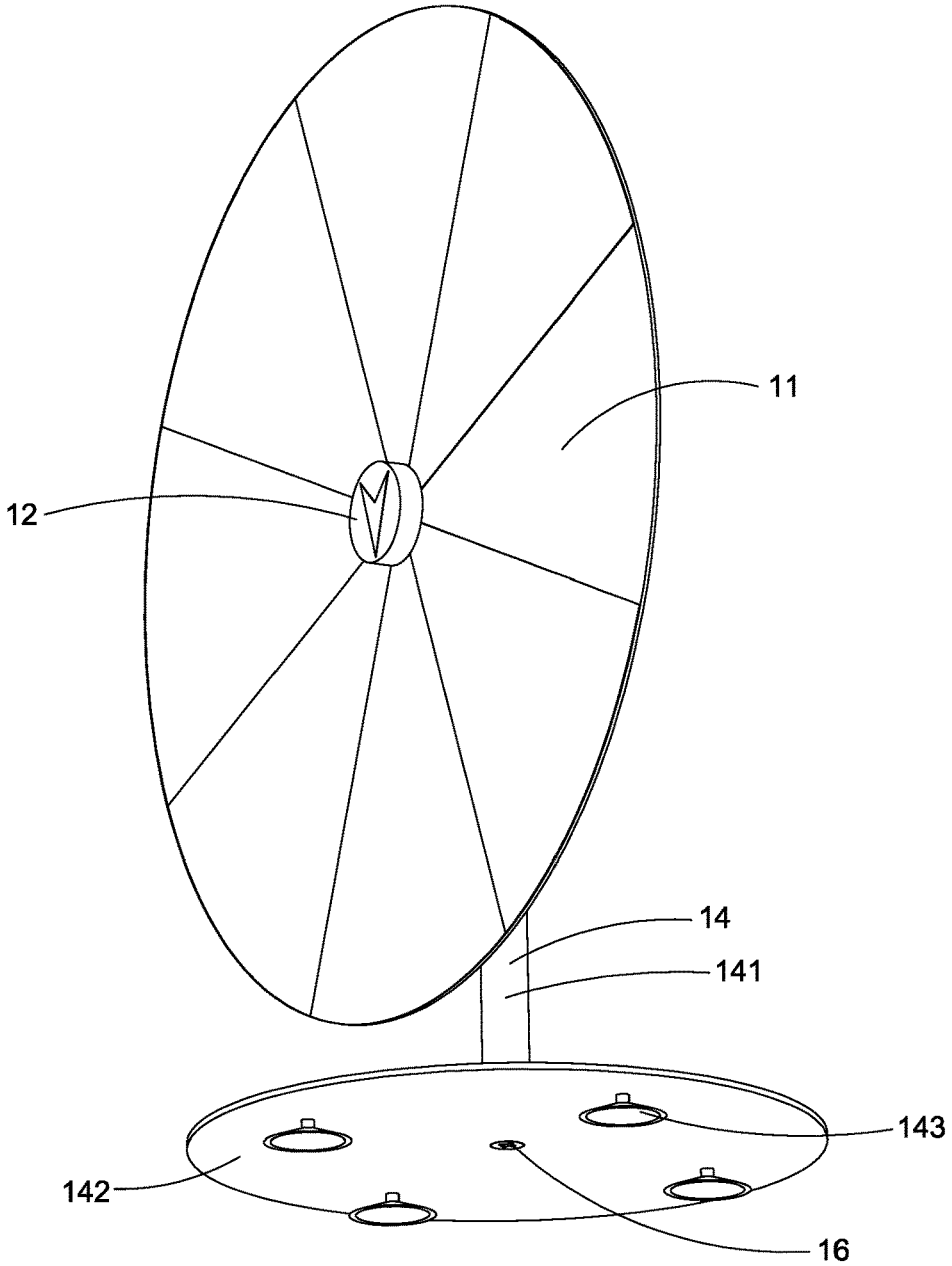
FIG. 15 is a perspective view of a spinning wheel toy according to a third preferred embodiment of the present invention.
Figure 16:
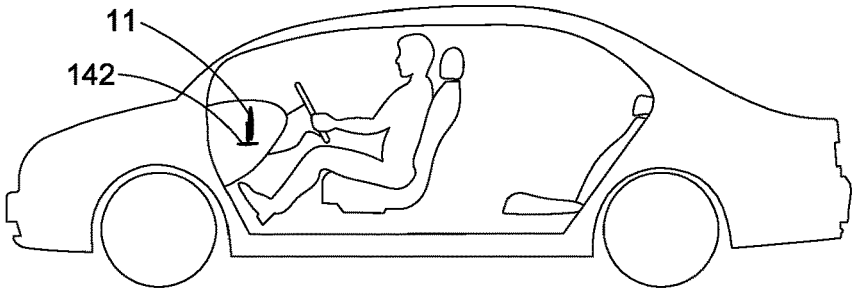
FIG. 16 is a perspective view illustrating the spinning wheel toy being used in a vehicle according to the above third preferred embodiment of the present invention.

As shown in FIG. 15 to FIG. 16 of the drawings, a spinning wheel toy according to a third preferred embodiment of the present invention is illustrated, the spinning wheel toy is shown to be used in a vehicle. For example, the spinning wheel toy can be placed on top of a dashboard of the vehicle for a driver to play when he is not driving the vehicle.

Similar to the above embodiments, the spinning wheel toy comprises a spinning disk 11, a pointer 12, a support 13 and a stand 14, wherein the pointer 12 and the spinning disk 11 are detachably mounted to the support 13 in a manner that the spinning disk 11 is able to rotate about the static pointer 12, and the support 13 is mounted to the stand 14 which can be placed on a desk 20, the spinning wheel toy 10 has a relatively small size that it is designed for personal use in the vehicle.

In this embodiment, the stand 14 comprises a fixing rod 141 and a base 142, and the fixing rod 141 is detachably mounted to the base 142. The stand 14 further comprises one or more attaching members 143 each can be a silicon sucker, so that when the stand 14 is placed on top of the dashboard, the silicon sucker can be firmly attached to the top surface of the dashboard by means of a negative pressure, and thus the spinning wheel toy can be stably mounted on the top surface of the dashboard of the vehicle.

In the present invention, the pointer 12 and the pinning disk 11 can be detachably mounted with the support 13, the support 13 can be detachably mounted to the stand 14, the fixing rod 141 can be detachably mounted to the base 142 of the stand 14, so that the components can be disassembled for easy transportation and storage, and the assembling process is convenient, so that the user can quickly assemble the spinning wheel toy for use.

Figure 17:
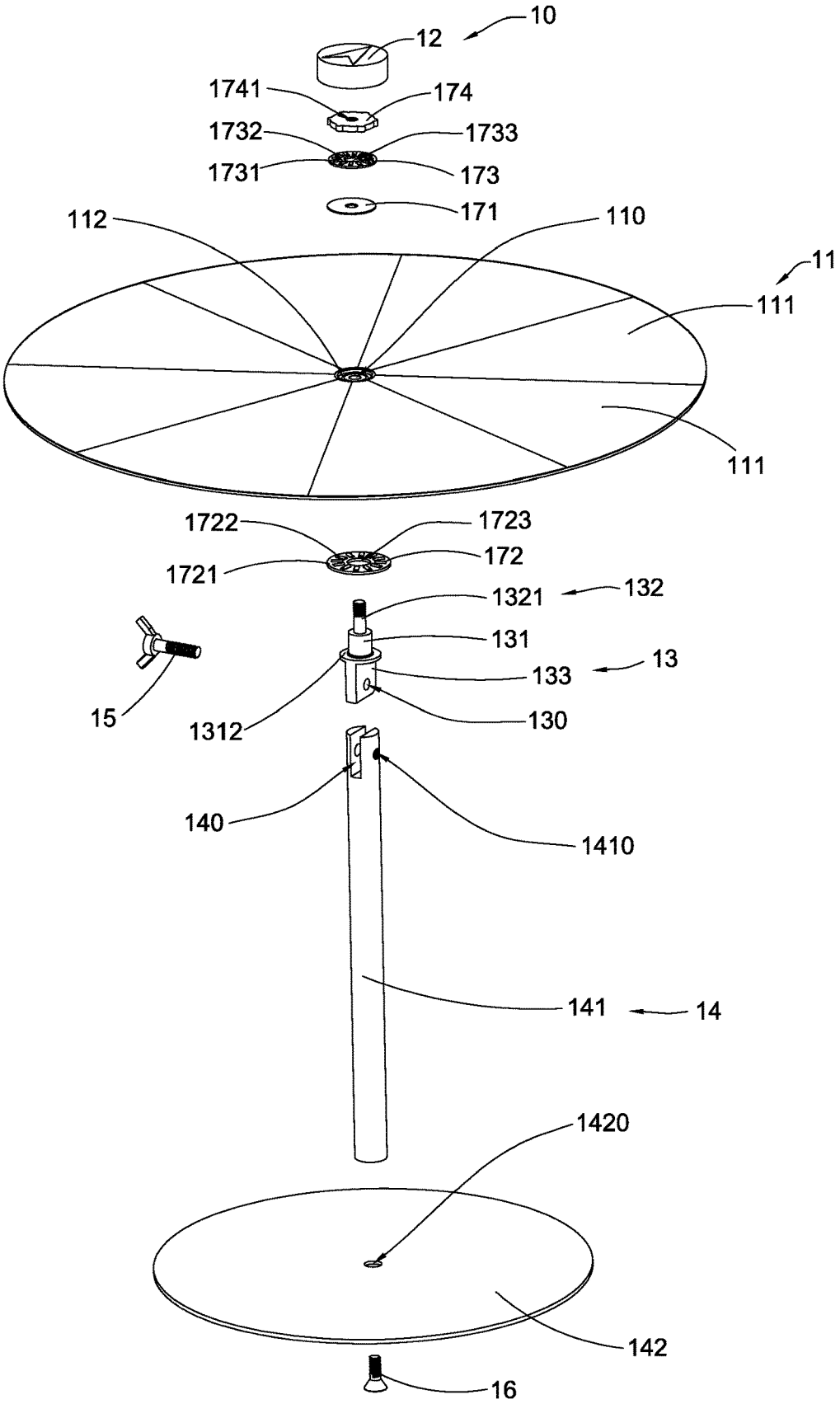
FIG. 17 is an exploded view of a spinning wheel toy according to a fourth preferred embodiment of the present invention.
Figure 18:
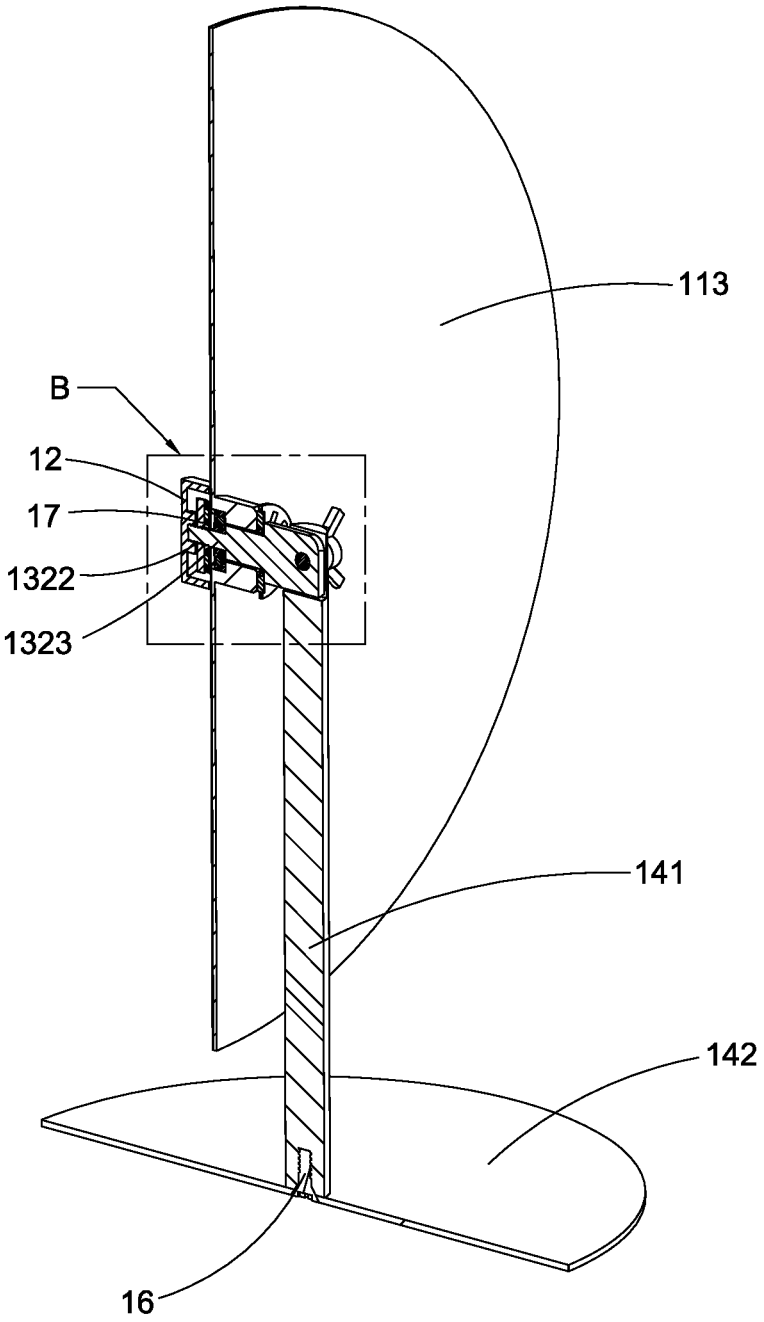
FIG. 18 is a sectional view illustrating a damping assembly of the spinning wheel toy according to the above fourth preferred embodiment of the present invention.
Figure 19:
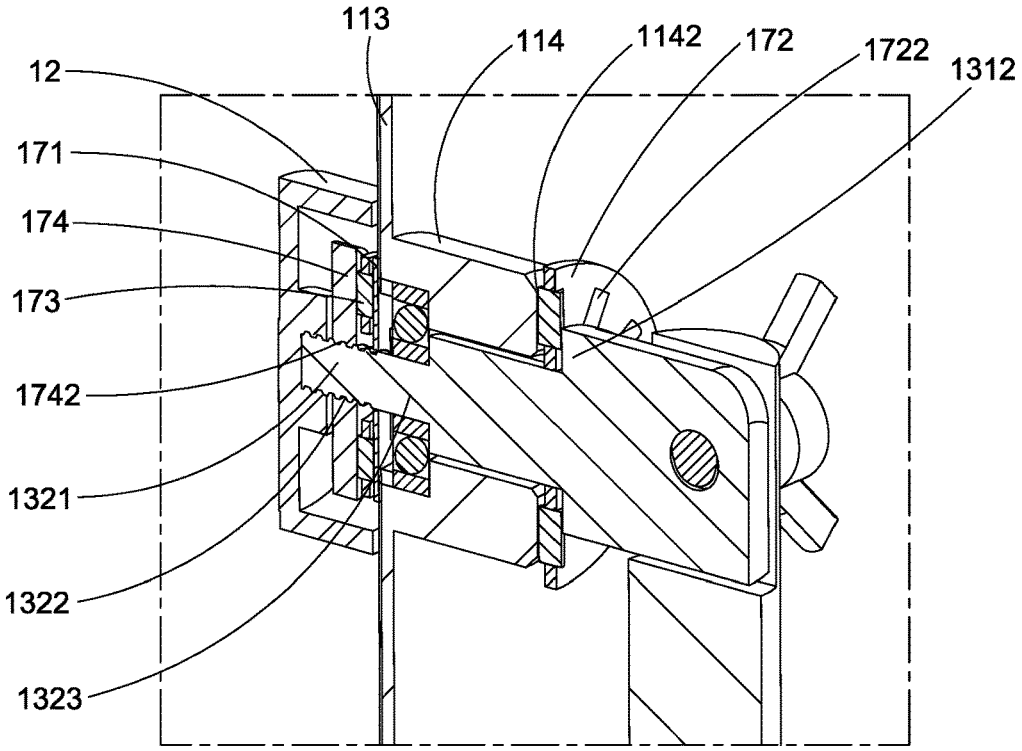
FIG. 19 is a partial enlarged sectional view of area B of FIG. 18.

Referring to FIGS. 17 to 19, a spinning wheel toy 10 according to a fourth preferred embodiment of the present invention is illustrated. The spinning wheel toy 10 comprises a spinning disk 11, a pointer 12, a support 13 and a stand 14, wherein the pointer 12 and the spinning disk 11 are detachably mounted to the support 13 in a manner that the spinning disk 11 is able to rotate about the static pointer 12, and the support 13 is mounted to the stand 14 which can be placed on a desk 20.

In this embodiment, the spinning wheel toy 10 further comprises a damping assembly 17 which comprises a damping ring 171, a first plane bearing 172, a second plane bearing 173, and an adjusting knob 174, wherein the damping ring 171, the first plane bearing 172, the second plane bearing 173, and the adjusting knob 174 are engaged with the fixing axle 132 for reducing the rotating speed of the spinning disk 11, so that the spinning disk 11 can stop in a short period of time. In other words, the user will not wait for very long before the spinning disk 11 stops rotation.

In this embodiment, the damping ring 171 can be provided between the pointer 12 and the disk body 113 of the spinning disk 11 to having frictional contact with the spinning disk 11, so that the rotating time of the spinning disk 11 will be reduced. Accordingly, the damping ring 171 can be contacting with the disk body 113 to reduce the rotating speed of the spinning disk 11, and is spaced apart from the pointer 12, so as to prevent the pointer 12 from being driven to rotate along with the spinning disk 11.

The first plane bearing 172 is provided between the seat portion 1312 of the adapter 131 and the end 1142 of the mounting member 114, the second plane bearing 173 is provided between the damping ring 171 and the adjusting knob 174, and the adjusting knob 174 can be provided between the pointer 12 and the second plane bearing 173.

Accordingly, two plane bearings 172 and 173 are provided at two sides of the spinning disk 11, so that the smooth rotation of the spinning disk 11 is ensured. The damping ring 171, which can be made of metal, preferably resilient plastic material such as rubber and silicon, is arranged between the two plane bearings 172 and 173 and is having a frictional contact with the disk body 113 of the spinning disk 11, so that when the disk body 113 of the spinning disk 11 is driven to rotate, the frictional contact between the disk body 113 of the spinning disk 11 and the damping ring 171 will result in a reduced rotating speed of the spinning disk 11.

The first plane bearing 172 comprises a first plane ring 1721, a plurality of first bearing members 1722 rotatably provided in the first plane ring 1721, and has a first penetrating hole 1723. The second plane bearing 173 comprises a second plane ring 1731, a plurality of second bearing members 1732 rotatably provided in the second plane ring 1731, and has a second penetrating hole 1733. The axle portion 1323 of the fixing axle 132 can be arranged to penetrate the first penetrating hole 1723 of the first plane bearing 172, the damping ring 171, the second penetrating hole 1733 of the second plane bearing 173 for mounting the damping ring 171, the first plane bearing 172 and the second plane bearing 173 on the fixing axle 132.

The adjusting knob 174, which is provided between the pointer 12 and the second plane bearing 173, has a knob hole 1741 and comprises inner threads 1742 around the knob hole 1741 for engaging with the threaded end portion 1322 of the fixing axle 132, so that when the adjusting knob 174 is rotated to move on the threaded end portion 1322 of the fixing axle 132, the positions of the damping ring 171 and the second plane bearing 173 on the axle portion 1323 of the fixing axle 132 can be adjusted, so as to adjust the damping effect of the damping assembly 17.

It is worth mentioning that when the adjusting knob 174 is arranged on the threaded end portion 1322 of the fixing axle 132, the adjusting knob 174 is spaced apart from the pointer 12, so as to prevent the adjusting knob 174 to drive the pointer 12 to rotate when the spinning disk 11 is driven to rotate.

Figure 20:
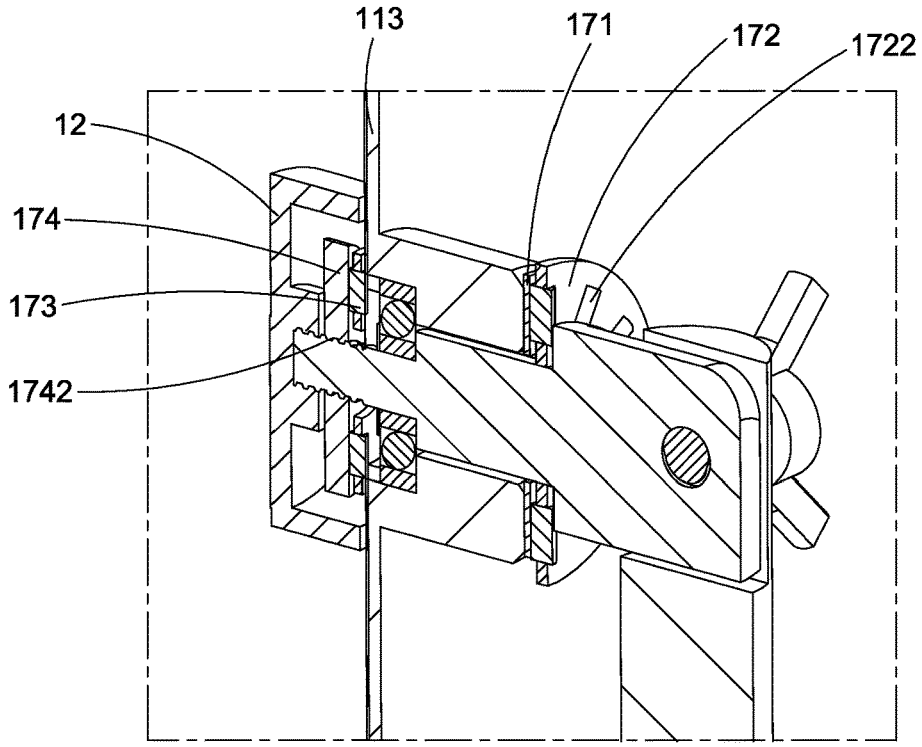
FIG. 20 is a partial enlarged sectional view illustrating a damping assembly of the spinning wheel toy according to an alternative mode of the above fourth preferred embodiment of the present invention.

As shown in FIG. 20 of the drawings, as an alternative mode, the damping ring 171 can be provided between the end 1142 of the mounting member 114 and first plane bearing 172, so that the damping ring 171 is having contact with a back surface of the disk body 113 of the spinning disk 11. Accordingly, in this embodiment, the first plane bearing 172 is provided between the seat portion 1312 and the damping ring 171, the second plane bearing 173 is provided between the disk body 113 of the spinning disk 11 and the adjusting knob 174, and the adjusting knob 174 is arranged between the pointer 12 and the second plane bearing 173, so that the rotating speed of the spinning wheel 11 can be reduced in a single spinning play.

It is worth mentioning that it is found that by employing the damping assembly 17 of this embodiment, the spinning wheel 11 will not rotate back and forth before the spinning wheel 11 stops rotation, so as to enhance the use experience.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A spinning wheel toy, comprising:

a spinning disk;

a pointer;

a support, wherein said spinning disk and said pointer are detachably mounted to said support; and a stand for supporting said support, wherein said support comprises a fixing axle, wherein said spinning disk has a central hole, wherein said fixing axle is arranged to penetrate through said central hole of said spinning disk for detachably mounting said pointer, wherein said fixing axle comprises a threaded end portion, wherein said pointer comprises an engaging portion having an engaging hole, wherein said threaded end portion of said fixing axle is arranged to be engaged with said engaging hole of said engaging portion of said pointer for detachably mounting said pointer with said support;

wherein said pointer comprises a cap portion and an arrow mark on said cap portion, wherein said engaging portion is disposed in said cap portion to define a circular groove around said engaging portion.

2. A spinning wheel toy, comprising:

a spinning disk;

a pointer;

a support, wherein said spinning disk and said pointer are detachably mounted to said support; and a stand for supporting said support;

wherein said support comprises a fixing axle, wherein said spinning disk has a central hole, wherein said fixing axle is arranged to penetrate through said central hole of said spinning disk for detachably mounting said pointer;

wherein said fixing axle comprises an axle portion, wherein said spinning disk comprises a rotation bearing disposed in said central hole to allow said axle portion of said fixing axle to pass through, so as to allow said spinning disk to rotate about said axle portion of said fixing axle;

wherein said spinning disk comprises a disk body and a mounting member extended from said disk body, wherein said disk body has a middle hole, said mounting member has a middle groove aligned with said middle hole of said disk body to form said central hole of said spinning disk, wherein said rotation bearing has a bearing hole and said rotation bearing is disposed in said middle groove of said mounting member, wherein said fixing axle is arranged to penetrate said bearing hole of said rotation bearing for coupling with said pointer;

wherein said support further comprises an adapter which comprises a cylindrical engaging portion extended from said axle portion for engaging with said middle groove of said mounting member, wherein said rotation bearing is disposed in said mounting member to form an indented groove in said mounting member, wherein said cylindrical engaging portion is arranged to bias against said rotation bearing when said cylindrical engaging portion is disposed into said indented groove;

wherein said spinning disk further comprises a retaining ring and a plurality of balls, wherein said retaining ring and said plurality of balls are disposed in said mounting member, wherein a raceway is defined between said retaining ring and said rotation bearing, wherein said plurality of balls is disposed in said raceway;

wherein said adapter further comprise a seat portion, wherein said cylindrical engaging portion is extended from said seat portion, wherein a damping ring is wound around said cylindrical engaging portion and sandwiched between an end of said mounting member and said seat portion.

3. A spinning wheel toy, comprising:

a spinning disk;

a pointer;

a support, wherein said spinning disk and said pointer are detachably mounted to said support, wherein said support comprises a fixing axle, wherein said spinning disk has a central hole, wherein said fixing axle is arranged to penetrate through said central hole of said spinning disk for detachably mounting said pointer;

a stand for supporting said support; and a damping ring which is arranged to be wound around said fixing axle of said support and provided between said pointer and said spinning disk.

4. A spinning wheel toy, comprising:

a spinning disk;

a pointer;

a support, wherein said spinning disk and said pointer are detachably mounted to said support; and a stand for supporting said support;

wherein said support comprises a fixing axle, wherein said spinning disk has a central hole, wherein said fixing axle is arranged to penetrate through said central hole of said spinning disk for detachably mounting said pointer;

wherein said fixing axle comprises an axle portion, wherein said spinning disk comprises a rotation bearing disposed in said central hole to allow said axle portion of said fixing axle to pass through, so as to allow said spinning disk to rotate about said axle portion of said fixing axle;

wherein said spinning disk comprises a disk body and a mounting member extended from said disk body, wherein said disk body has a middle hole, said mounting member has a middle groove aligned with said middle hole of said disk body to form said central hole of said spinning disk, wherein said rotation bearing has a bearing hole and said rotation bearing is disposed in said middle groove of said mounting member, wherein said fixing axle is arranged to penetrate said bearing hole of said rotation bearing for coupling with said pointer;

wherein the spinning wheel toy further comprises a damping ring which is arranged to be wound around said fixing axle of said support and provided between said pointer and said spinning disk to have a contact with said rotation bearing and is spaced apart from said pointer.

5. A spinning wheel toy, comprising:

a spinning disk;

a pointer;

a support, wherein said spinning disk and said pointer are detachably mounted to said support; and a stand for supporting said support;

wherein said support comprises a fixing axle, wherein said spinning disk has a central hole, wherein said fixing axle is arranged to penetrate through said central hole of said spinning disk for detachably mounting said pointer; and a damping assembly which comprises a damping ring, a first plane bearing, and a second plane bearing, wherein said damping ring, said first plane bearing, and said second plane bearing are arranged to be mounted on said fixing axle, wherein said first plane bearing and said second plane bearing are arranged to be provided at two sides of said spinning disk, wherein said damping ring is arranged between said spinning disk and one of said first plane bearing and said second plane bearing to have a frictional contact with said spinning disk.

6. The spinning wheel toy according to claim 5, wherein said fixing axle comprises a threaded end portion and an axle portion, wherein said damping ring, said first plane bearing, and said second plane bearing are arranged on said axle portion of said fixing axle, wherein said damping assembly further comprises an adjusting knob which is arranged to be coupled with said threaded end portion by threads, so as to adjust position of said damping ring.

7. A spinning wheel toy, comprising:

a spinning disk;

a pointer;

a support, wherein said spinning disk and said pointer are detachably mounted to said support; and a stand for supporting said support;

wherein said support comprises a fixing axle, wherein said spinning disk has a central hole, wherein said fixing axle is arranged to penetrate through said central hole of said spinning disk for detachably mounting said pointer;

wherein said fixing axle comprises an axle portion, wherein said spinning disk comprises a rotation bearing disposed in said central hole to allow said axle portion of said fixing axle to pass through, so as to allow said spinning disk to rotate about said axle portion of said fixing axle;

wherein said spinning disk comprises a disk body and a mounting member extended from said disk body, wherein said disk body has a middle hole, said mounting member has a middle groove aligned with said middle hole of said disk body to form said central hole of said spinning disk, wherein said rotation bearing has a bearing hole and said rotation bearing is disposed in said middle groove of said mounting member, wherein said fixing axle is arranged to penetrate said bearing hole of said rotation bearing for coupling with said pointer;

wherein said support further comprises an adapter which comprises a cylindrical engaging portion extended from said axle portion for engaging with said middle groove of said mounting member, wherein said rotation bearing is disposed in said mounting member to form an indented groove in said mounting member, wherein said cylindrical engaging portion is arranged to bias against said rotation bearing when said cylindrical engaging portion is disposed into said indented groove;

wherein said support comprises a retention element which is detachably mounted to said stand, wherein said retention element is extended from said adapter;

wherein said retention element is pivotally mounted to said stand, so as to allow a relative position between said support and said stand to be adjusted, so as to adjust a position of said spinning disk.

8. The spinning wheel toy according to claim 7, wherein said retention element has a first mounting hole, said stand comprises a fixing rod comprising an upper fixing portion having a slot and two fixing parts each having a second mounting hole, wherein said slot is defined between said two fixing parts, wherein a fixing blot element is arranged to penetrate through said first mounting hole and said second mounting holes to detachably and pivotally mount said retention element at said slot of said fixing rod.

9. The spinning wheel toy according to claim 8, wherein said stand further comprises a base, wherein said fixing rod is detachably mounted to said base, wherein said fixing rod comprises a lower fixing portion having a lower fixing hole, said base has an assembling hole, wherein a securing element is arranged to pass through said assembling hole to engaged with said lower fixing hole of said fixing rod to detachably mount said base with said fixing rod.

10. The spinning wheel toy according to claim 9, further comprising one or more attaching member each is a silicon sucker provided at a bottom of said base.

* * * * *